US005371800A

United States Patent [19]

Komatsu et al.

[11] Patent Number: 5,371,800

[45] Date of Patent: Dec. 6, 1994

[54] SPEECH DETECTION CIRCUIT

[75] Inventors: Noriyoshi Komatsu; Masahiro Aota; Seiji Komatsuda; Toshihiro Ibuka, all of Sendai; Yoshihiro Matsumoto, Kawasaki, all of Japan

[73] Assignee: Fujitsu Limited, Kawasaki, Japan

[21] Appl. No.: 777,184

[22] Filed: Oct. 16, 1991

[30] Foreign Application Priority Data

Oct. 16, 1990 [JP] Japan ..... 2-277433

[51] Int. Cl.[5] ..... G10L 5/00

[52] U.S. Cl. ..... 381/46; 381/57

[58] Field of Search ..... 330/129, 131; 381/46, 381/57, 104, 107, 110, 108, 106

[56] References Cited

U.S. PATENT DOCUMENTS

| | | | |
|---|---|---|---|
| 2,249,181 | 7/1941 | Shepard | 330/131 |
| 2,312,934 | 3/1943 | Shook | 330/131 |
| 2,316,354 | 4/1943 | Moritz | 330/129 |
| 3,873,926 | 3/1975 | Wright | 381/107 |
| 4,044,309 | 8/1977 | Smith | 381/107 |
| 4,119,797 | 10/1978 | Wollert | 381/110 |
| 4,442,407 | 4/1984 | Apel | 330/129 |
| 4,741,018 | 4/1988 | Potratz et al. | 379/58 |
| 5,126,688 | 6/1992 | Nakanishi et al. | 330/129 |

FOREIGN PATENT DOCUMENTS 0100080 2/1984 European Pat. Off. ..... 381/110

OTHER PUBLICATIONS

In Re Fox, 176 U.S. P.Q. 340 at 341 (1973).

*Primary Examiner*—Allen R. MacDonald
*Assistant Examiner*—M. Sartori
*Attorney, Agent, or Firm*—Staas & Halsey

[57] ABSTRACT

A speech detection circuit includes an amplifier for amplifying an input audio signal and having a variable gain, a rectifying circuit for rectifying an output signal of the amplifier, a comparator for comparing an output signal level of the rectifying circuit with a reference level, and a control circuit for outputting a control signal based on an output signal of the comparator. The control circuit outputs a control signal which indicates a power save mode after a predetermined time elapses from a time when the output signal level of the rectifying circuit becomes less than or equal to the reference level, and outputs a control signal which indicates a normal mode immediately when the output signal level of the rectifying circuit becomes greater than the reference level. The amplifier receives the control signal output from the control circuit and reduces its gain when the control signal indicates the power save mode.

8 Claims, 6 Drawing Sheets

SPEECH DETECTION CIRCUIT

BACKGROUND OF THE INVENTION

The present invention generally relates to speech detection circuits, and more particularly to a speech detection circuit which is suited for use in a control part of a mobile communication terminal.

In mobile communication terminals, it is desirable to extend the serviceable life of a built-in battery as long as possible. For this reason, a speech detection circuit is required to detect the existence of speech during communication and carry out a power save operation when no speech input exists.

FIG. 1 shows an example of a conventional speech detection circuit. In FIG. 1, a microphone 10 picks up speech and outputs an audio signal. An amplifier 20 amplifies the audio signal output from the microphone 10, and a bandpass filter 30 eliminates noise included in an output signal of the amplifier 20. A coupling capacitor C1 eliminates a D.C. component included in an output signal of the bandpass filter 30. R1 denotes an input resistance of an amplifier 12, and R2 denotes a feedback resistance of the amplifier 12. The resistances R1 and R2 together determine a gain of the amplifier 12.

A rectifying circuit 2 rectifies an output signal of the amplifier 12 and outputs a D.C. voltage. A comparator 3 compares the output signal of the rectifying circuit 2 with a reference level S, and supplies an output signal which controls the ON/OFF state of a switch 41. A capacitor C2 is connected in parallel to the switch 41, and a constant current source 42 is connected in series to a parallel circuit which is made up of the capacitor C2 and the switch 41. A shaping circuit 43 shapes an output voltage waveform of the capacitor C2. For example, a one-shot multivibrator is used as the shaping circuit 43.

Next, a description will be given of an operation of the conventional speech detection circuit shown in FIG. 1, by referring to FIG.2. In FIG. 2, (A) shows an input signal waveform at an output of the capacitor C1, (B) shows a rectified signal output from the rectifying circuit 2, and (C) shows an output signal OUT1 which is output from the shaping circuit 43.

First, the audio signal from the microphone 10 is passed through the amplifier 20 and the bandpass filter 30, and the D.C. component of the audio signal is eliminated by the capacitor C1 before being supplied to the amplifier 12. Hence, the signal shown in FIG. 2(A) is supplied to the amplifier 12 and is amplified with a gain G which is determined by the resistances R1 and R2. The output signal of the amplifier 12 is passed through the rectifying circuit 2 and is formed into the D.C. signal shown in FIG. 2(B).

The comparator 3 compares the D.C. signal shown in FIG. 2(B) with the reference level S. Hence, when the signal received via the capacitor C1 has the signal waveform shown in FIG. 2(A), the output signal level of the comparator 3 becomes high at a time t1 when the rectified (D.C.) signal shown in FIG. 2(B) falls below the reference level S. The switch 41 is switched from the closed state to the open state when the output signal level of the comparator 3 becomes high. In this case, however, FIG.2(A) shows the signal waveform before being amplified with the gain G in the amplifier 12, and thus, the the actual input signal level to the comparator 3 after the amplification with the gain G is (S-G) dBV as shown in FIG. 2(A).

When the switch 41 is opened, the charging of the capacitor C2 by the constant current source 42 starts. At a time t2 when the voltage at the capacitor C2 becomes greater than or equal to a predetermined value (for example, approximately two seconds after the time t1), the output signal OUT1 of the shaping circuit 43 undergoes a transition from a low level which indicates a normal operation in which no power save is made to a high level which indicates a power save operation.

When the amplitude of the signal becomes large again as shown in FIG.2(A), the output signal level of the comparator 3 becomes low at a time t3 when the input signal level (S-G) is exceeded. Hence, the switch 41 is switched from the open state to the closed state. As a result, the charge in the capacitor C2 is instantaneously discharged via the switch 41, thereby immediately changing the signal level of the output signal OUT1 of the shaping circuit 43 to the low level to indicate the normal operation. In other words, the operation returns to the normal operation from the power save operation.

However, according to the conventional speech detection circuit, the input signal level used for switching the operation from the normal operation to the power save operation and the input signal level used for switching the operation from the power save operation to the normal operation are (S-G) and are the same. For this reason, when the surrounding noise level becomes high, for example, the input signal level (S-G) is easily exceeded. As a result, there is a problem in that the operation returns to the normal operation although originally the power save operation should be continued. In other words, the operation is erroneously returned to the normal operation from the power save operation when the noise level is relatively high.

SUMMARY OF THE INVENTION

Accordingly, it is a general object of the present invention to provide a novel and useful speech detection circuit in which the problem described above is eliminated.

Another and more specific object of the present invention is to provide a speech detection circuit comprising amplifier means for amplifying an input audio signal and having a variable gain, rectifying circuit means, coupled to the amplifier means, for rectifying an output signal of the amplifier means, comparator means, coupled to the rectifying circuit means, for comparing an output signal level of the rectifying circuit means with a reference level, and control circuit means, coupled to the comparator means, for outputting a control signal based on an output signal of the comparator means, where the control circuit means outputs a control signal which indicates a power save mode after a predetermined time elapses from a time when the output signal level of the rectifying circuit means becomes less than or equal to the reference level, and outputs a control signal which indicates a normal mode immediately when the output signal level of the rectifying circuit means becomes greater than the reference level. The amplifier means receives the control signal output from the control circuit means and reduces its gain when the control signal indicates the power save mode. According to the speech detection circuit of the present invention, the gain of the amplifier means is smaller in the power save mode than in the normal mode, and the reference level of the comparator means at the time when the power save mode is cancelled is substantially increased to start and cancel the power save mode with a hysteresis characteristic. For this reason, the power save mode will not be erroneously cancelled even when the input audio signal waveform varies from the reference level for the normal mode due to noise and the like. Therefore, the characteristic of the circuit against noise is considerably improved in that the power save mode is cancelled immediately only when the input audio signal waveform reaches a reference level which is higher than that for the normal mode.

Still another object of the present invention is to provide the speech detection circuit described above which is applied to a mobile communication terminal which includes a transmitting system having first and second parts, and a switch for switching an operation mode between the normal mode and the power save mode, wherein the control signal output from the control circuit means controls the switch to supply a power source voltage to only the first part of the transmitting system in the power save mode, and the second part has a power consumption greater than that of the first part. According to the speech detection circuit of the present invention, the power save mode is unaffected by noise and the like which conventionally cancelled the power save mode in error.

Other objects and further features of the present invention will be apparent from the following detailed description when read in conjunction with the accompanying drawings.

DESCRIPTION OF THE PREFERRED EMBODIMENTS

Figure 3:
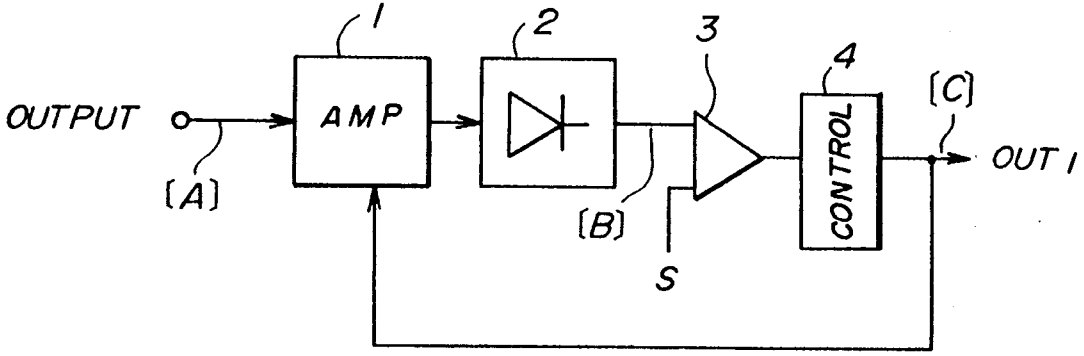
FIG. 3 is a system block diagram for explaining an operation principle of the present invention.

First, a description will be given of an operating principle of the present invention, by referring to FIG. 3.

An input audio signal is supplied to an amplifier 1 having a variable gain. An output signal of this amplifier 1 is rectified in a rectifying circuit 2, and an output signal of the rectifying circuit 2 is compared with a reference level S in a comparator 3. A control circuit 4 outputs a power save control signal OUT1 for indicating a power save mode after a predetermined time elapses from a time when the output signal level of the rectifying circuit 2 becomes less than or equal to the reference level S. On the other hand, the control circuit 4 outputs a power save control signal OUT1 for switching an operation from the power save operation to a normal operation immediately when the output signal level of the rectifying circuit 2 becomes greater than the reference level S. In this latter case, the gain of the amplifier 1 is reduced to that for the normal operation in response to the power save control signal OUT1 from the control circuit 4.

First, it is assumed for the sake of convenience that the normal operation is being carried out and the amplifier 1 has a gain G1. The input audio signal is amplified with the gain G1 in the amplifier 1, and is formed into a D.C. signal by the rectifying circuit 2. This D.C. signal from the rectifying circuit 2 is compared with the reference level S in the comparator 3. When the signal waveform of the input audio signal is such that the input signal level falls below S-G1, the power save control signal OUT1 output from the control circuit 4 undergoes a transition to indicate the power save operation after a predetermined elapses from a time when the input signal level falls below S-G1. Accordingly, the operation changes to the power save operation, but at the same time, the power save control signal OUT1 is also supplied to the amplifier 1 to change the gain thereof from G1 to G2.

The relationship of the gains G1 and G1 is such that G1>G2. Hence, the reference level of the comparator 3 substantially rises from S-G1 to S-G2.

Therefore, even if the input audio signal changes due to noise or the like from the input level S-G1 at the time of the normal operation, the power save operation will not be erroneously cancelled by this change, and the power save operation is immediately cancelled only when the input audio signal reaches the input level S-G2 which is higher than S-G1. In other words, a hysteresis characteristic corresponding to the gain G1-G2 is obtained for the switching of the operation from the normal operation to the power save operation and vice versa.

Figure 4:
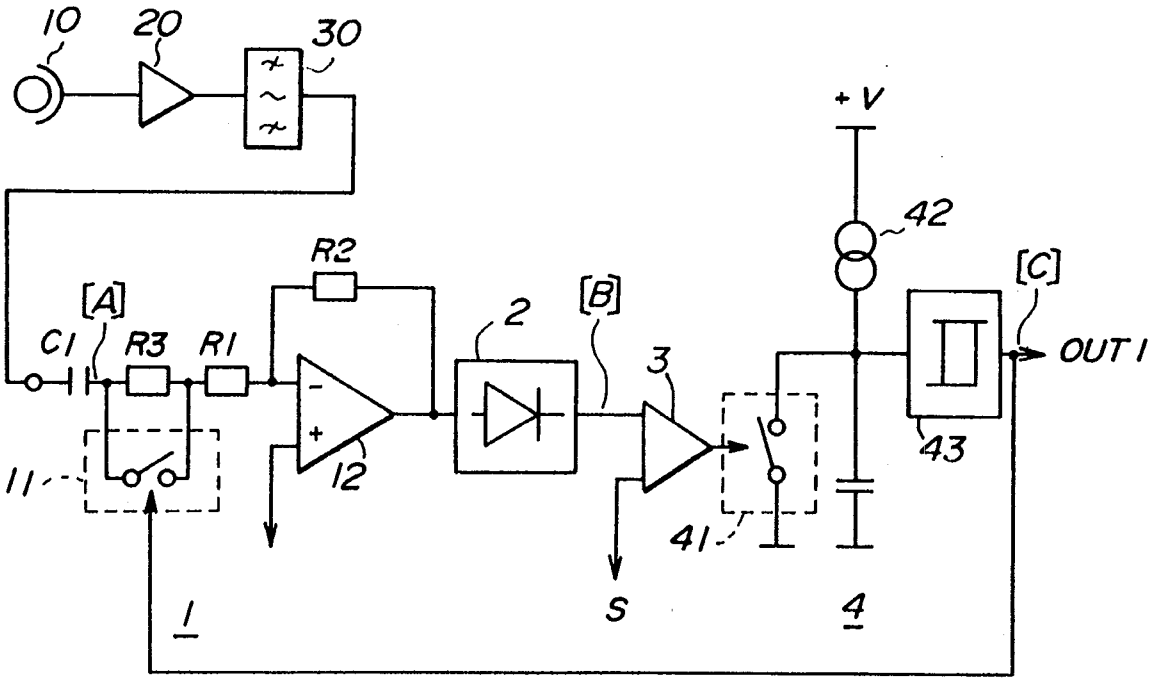
FIG. 4 is a system block diagram showing an embodiment of a speech detection circuit according to the present invention.
Figure 5:
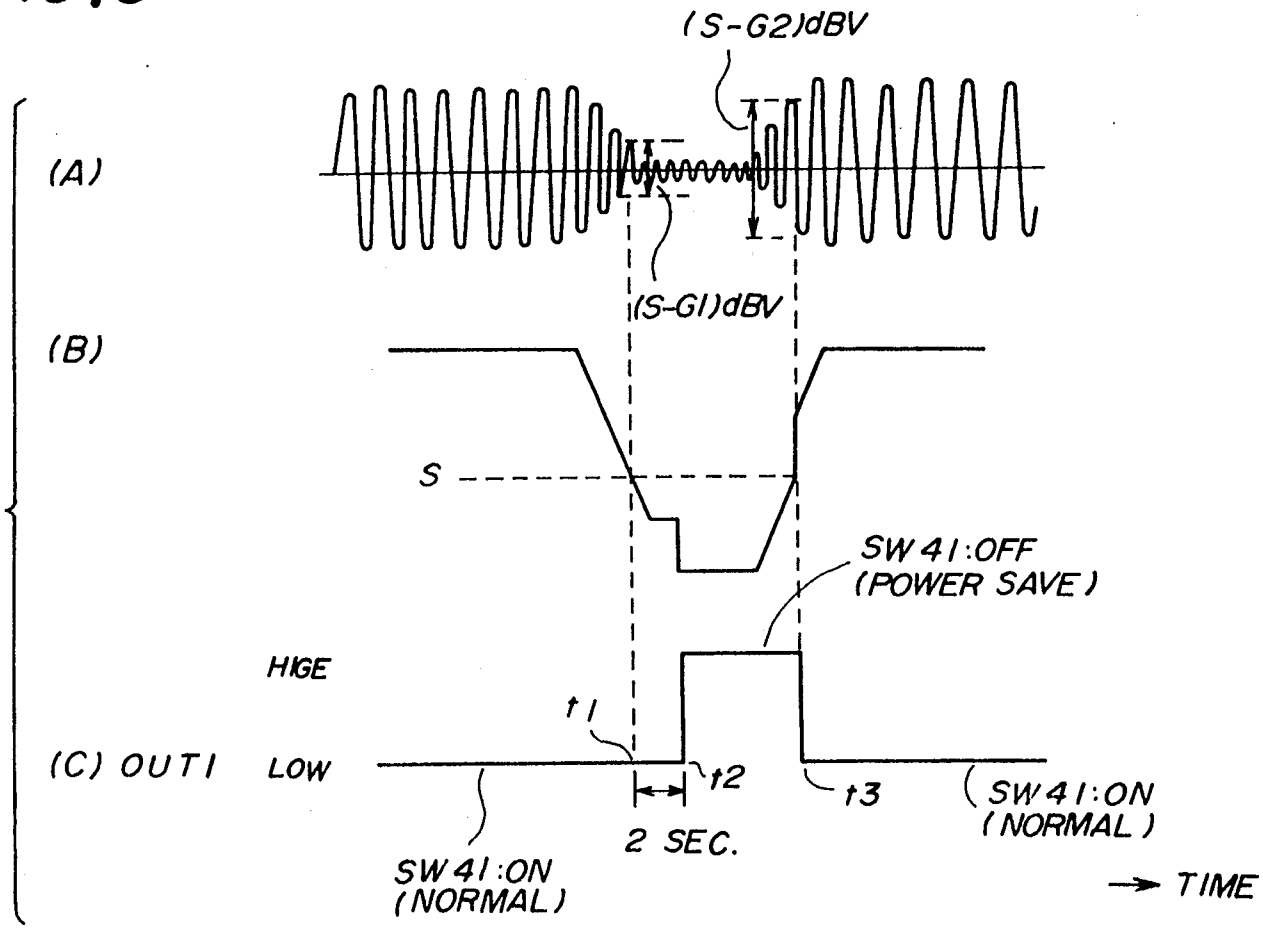
FIG. 5 is a time chart for explaining an operation of the embodiment shown in FIG. 4.

Next, a description will be given of an embodiment of the speech detection circuit according to the present invention, by referring to FIGS. 4 and 5. FIG. 4 shows the embodiment of the speech detection circuit, and FIG. 5 is a time chart for explaining an operation of this embodiment. In FIG. 4, those parts which are the same as those corresponding parts in FIG. 1 are designated by the same reference numerals, and a description thereof will be omitted.

Figure 1:
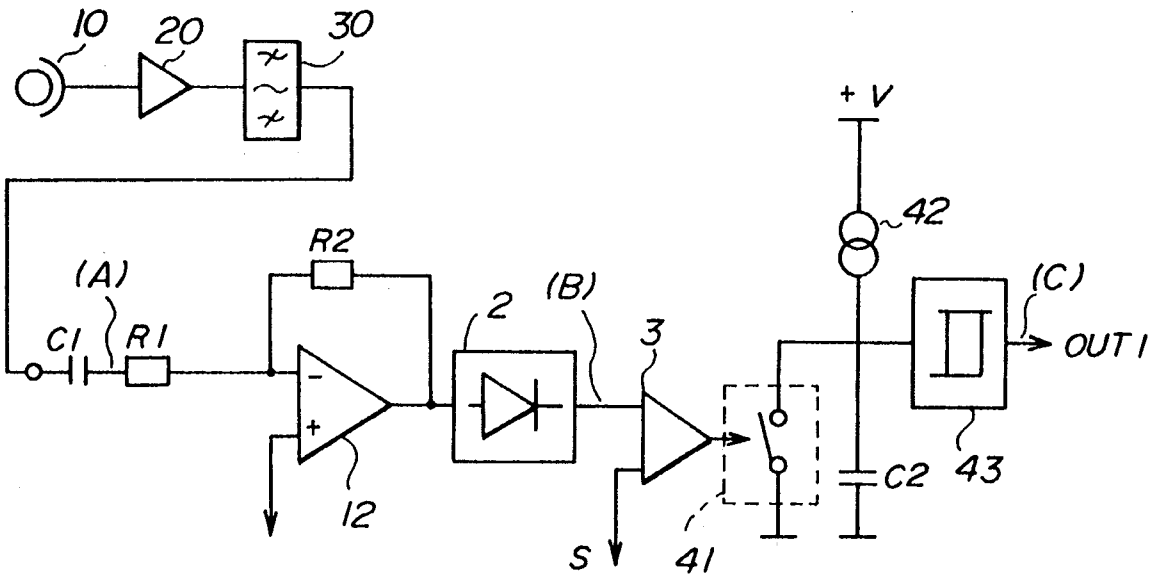
FIG. 1 PRIOR ART
FIG. 1 is a system block diagram showing an example of a conventional speech detection circuit.
Figure 2:
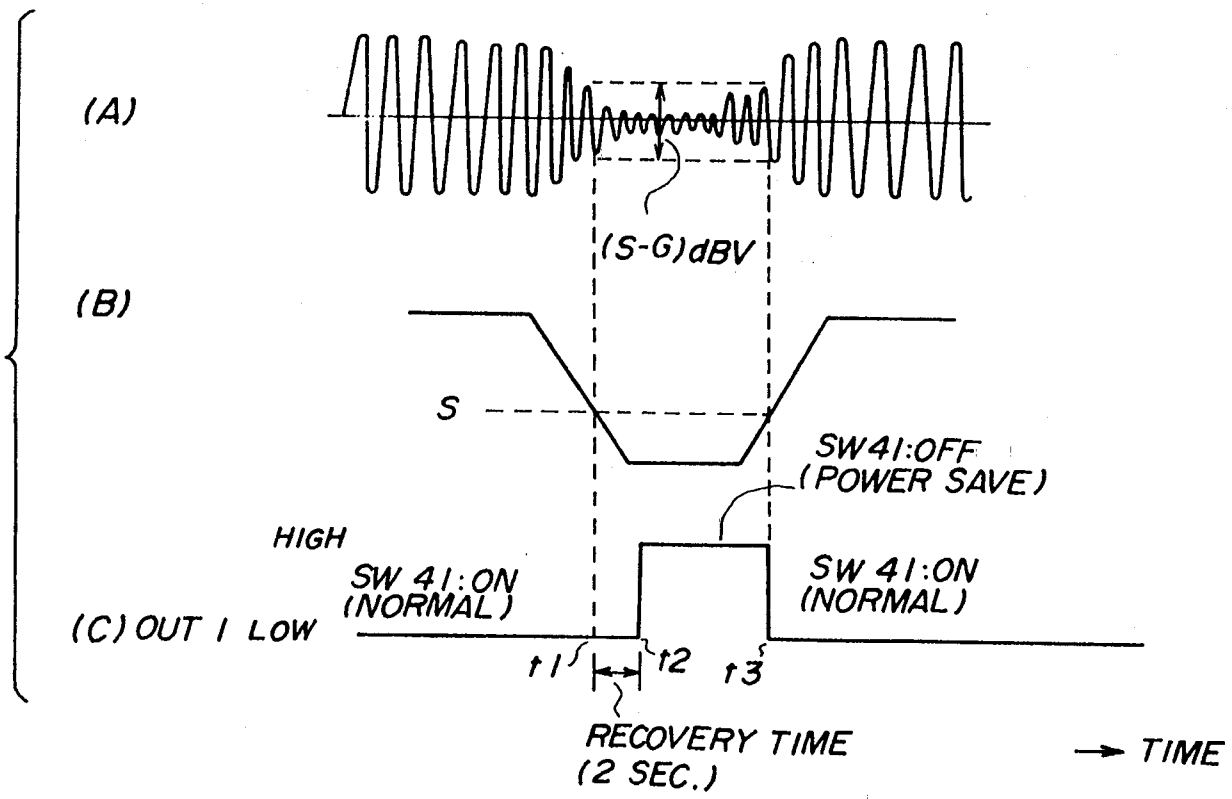
FIG. 2 PRIOR ART
FIG. 2 is a time chart for explaining an operation of the conventional speech detection circuit shown in FIG. 1.

This embodiment differs from the conventional speech detection circuit shown in FIG. 1 in that a variable gain amplifier 1 is provided. This variable gain amplifier 1 includes an input resistance R3 which is connected in series to the input resistance R1 and an analog switch 11 which is connected in parallel to the input resistance R3, in addition to the feedback resistance R2 and the amplifier 12. The analog switch 11 is turned ON/OFF in response to the output signal OUT1 of the shaping circuit 43, and the input resistance R3 is short-circuited when the analog switch 11 is ON. The switch 41, the constant current source 42, the capacitor C2 and the shaping circuit 43 form a control circuit 4.

First, the audio signal output from the microphone 10 is passed through the amplifier 20 and the bandpass filter 30, and the D.C. component of the audio signal is eliminated by the capacitor C1 before being supplied to the amplifier 12. FIG. 5(A) shows an audio signal received via the capacitor C1.

During the normal operation, the switch 11 of the variable amplifier 1 is ON, and the amplifier 12 amplifies the audio signal shown in FIG. 5(A) with a gain G1 which is determined by the resistances R1 and R2. The output signal of the amplifier 12 is passed through the rectifying circuit 2 and is formed into a D.C. signal shown in FIG. 5(B). The comparator 3 compares this D.C. signal with the reference level S.

When the audio signal at the point [A] in FIG. 4 has the signal waveform shown in FIG. 5(A), the output signal level of the comparator 3 becomes high at a time t1 when the rectified signal shown in FIG. 5(B) falls below the reference level S. The switch 41 is switched from the closed state to the open state in response to the high-level signal from the comparator 3. In this case, however, the audio signal shown in FIG. 5(A) is not yet amplified with the gain G1 in the amplifier 12. Accordingly, as in the case of the conventional circuit described above, the actual input signal level to the comparator 3 after the amplification with the gain G1 is (S-G1) dBV as shown in FIG. 5(A).

When the switch 41 is opened, the charging of the capacitor C2 by the constant current source 42 starts. At a time t2 when the voltage at the capacitor C2 becomes greater than or equal to a predetermined value (for example, approximately two seconds after the time t1) such that the shaping circuit 43 will operate, the power save control signal OUT1 output from the shaping circuit 43 undergoes a transition from a low level which indicates a normal operation in which no power save is made to a high level which indicates a power save operation.

Hence, the switch 11 is switched from the ON state to the OFF state in response to this high-level power save Control signal OUT1. As a result, the input resistance of the amplifier 12 becomes the resistance of a series circuit which is made up of the resistances R1 and R3, and the gain G1 is reduced to G2, where $G1=R2/R1$ and $G1>G2=R2/(R1+R3)$. For this reason, the reference level of the comparator 3 substantially rises from S-G1 (dBV) to S-G2 (dBV).

When the amplitude of the audio signal becomes large again as shown in FIG. 5(A), the comparator 3 continues to output the high-level signal even when the input level S-G1 is exceeded. The output signal level of the comparator 3 becomes low only at a time t3 when the input level S-G2 is exceeded. This input level S-G2 is higher than the input level S-G1 by an amount corresponding to the hysteresis characteristic shown. The switch 41 is switched back from the open state to the closed state in response to this low-level signal from the comparator 3.

When the switch 41 closes, the charge of the capacitor C2 is discharged instantaneously via the capacitor C2. For this reason, the output signal level of the shaping circuit 43 immediately becomes low, thereby outputting the power save control signal OUT1 which indicates the normal operation. In other words, the operation is returned to the normal operation.

In this embodiment, the gain G2 is determined so that the speech detection circuit operates when the tone of 1 kHz output from the amplifier 20 is −26 dBV, for example. The width of the hysteresis characteristic is determined by G1-G2. When the speech detection circuit is applied to a mobile communication terminal, for example, this width is determined to an appropriate value to suit the usage of the mobile communication terminal.

Next, a description will be given of a mobile communication terminal to which the present invention may be applied. For the sake of convenience, it is assumed that the above described embodiment is applied to the mobile communication terminal shown in FIG. 6.

Figure 6:
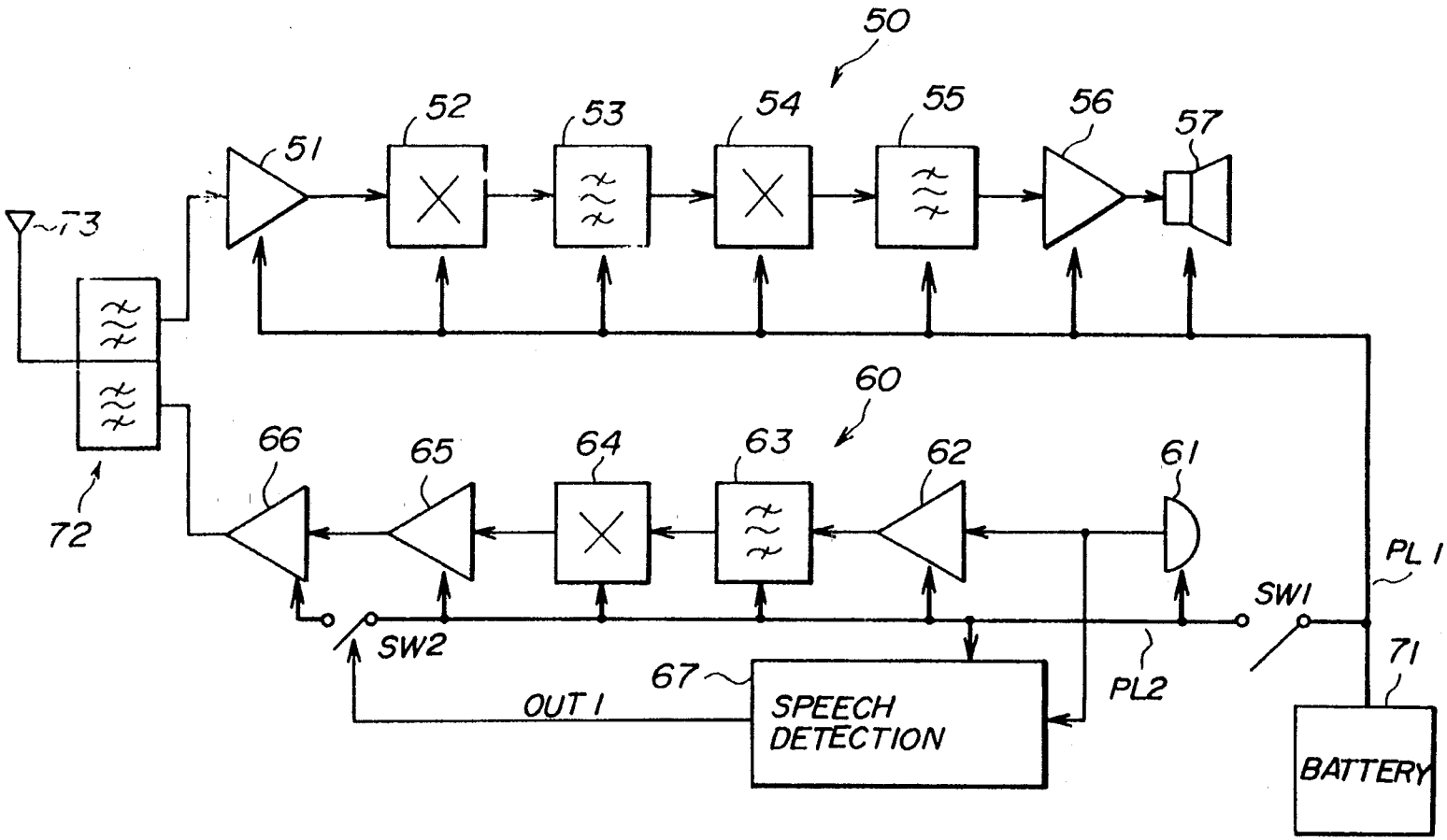
FIG. 6 is a system block diagram showing a mobile communication terminal to which the present invention may be applied.

In FIG. 6, a receiving system 50 of the mobile communication terminal includes an amplifier 51, a mixer 52, a filter 53, a detector circuit 54, a filter 55, an amplifier 56 and a speaker 57 which are coupled as shown. On the other hand, a transmitting system 60 of the mobile communication terminal includes a microphone 61, an amplifier 62, a filter 63, a modulator 64, an amplifier 65, a power amplifier 66 and a speech detection circuit 67 which are coupled as shown. The amplifier 51 receives a signal via an antenna 73 and a filter part 72. On the other hand, the output signal of the power amplifier 66 is transmitted via the filter part 72 and the antenna 73.

A battery 71 supplies a power source voltage to the receiving system via a power supply line PL1, and supplies the power source voltage to the transmitting system 60 via a power supply line PL2 when a switch SW1 is closed. The mobile communication terminal is normally in a receiving mode in which the switch SW1 is open and the receiving system 50 is ready to receive a call. The switch SW1 is closed when making a transmission so as to activate the transmitting system 60.

The speech detection circuit 67 receives an output audio signal of the microphone 61 which corresponds to the microphone 10 shown in FIG. 4. For example, this speech detection circuit 67 corresponds to the circuit part shown in FIG. 4 excluding the microphone 10. A power save control signal OUT1 output from the speech detection circuit 67 is supplied to a switch SW2 to control the ON/OFF state of the switch SW2. This switch SW2 is closed during the normal operation in which the elements of the transmitting system 60 including the power amplifier 66 receives the power source voltage via the power supply line PL2. However, when the power save control signal OUT1 indicates the power save mode, the switch SW2 is opened to cut off the power supply to the power amplifier 66, so as to carry out the power save operation.

In the case of the mobile communication terminal shown in FIG. 6, the power amplifier 66 consumes 80 to 90% of the total power consumed by the mobile communication terminal. Accordingly, the power consumption is greatly reduced by the power save operation.

In the described embodiment, the variable gain amplifier 1 uses the switch 11 to vary the input resistance. However, other known methods of varying the gain of the amplifier may be used.

Further, the present invention is not limited to these embodiments, but various variations and modifications may be made without departing from the scope of the present invention.

What is claimed is:

1. A speech detection circuit, comprising:

amplifier means for amplifying an input audio signal and outputting a first output signal, said amplifier means having a variable gain;

rectifying circuit means, coupled to said amplifier means, for rectifying the first output signal of said amplifier means and for outputting a second output signal having an output signal level;

comparator means, coupled to said rectifying circuit means, for comparing the output signal level of the second output signal of said rectifying circuit means with a reference level and for outputting a third output signal; and control circuit means, coupled to said comparator means, for outputting a control signal based on the third output signal of said comparator means, said control circuit means outputting a control signal which indicates a power save mode after a predetermined time elapses from a time when the second output signal level of said rectifying circuit means becomes less than or equal to the reference level, said control circuit means outputting a control signal which indicates a normal mode immediately when the second output signal level of said rectifying circuit means becomes greater than the reference level, and said amplifier means receiving the control signal output from said control circuit means and reducing the variable gain when the control signal indicates the power save mode.

2. The speech detection circuit as claimed in claim 1, wherein the gain of said amplifier means is controlled to a gain G1 when the control signal indicates the normal mode and is controlled to a gain G2 when the control signal indicates the power save mode, where G1>G2, to produce the reference level at said comparator means substantially changes from S-G1 to S-G2 when the control signal indicates the power save mode.

3. The speech detection circuit as claimed in claim 2, wherein the gain of said amplifier means is switched between G1 and G2 with a hysteresis characteristic in response to the control signal.

4. The speech detection circuit as claimed in claim 1, wherein the input audio signal is derived from a microphone.

5. The speech detection circuit as claimed in claim 1, wherein said control circuit means comprises:

a switch which is opened and closed in response to the output signal of said comparator means;

a node outputting a signal;

a power source;

a constant current source coupled between the power source and the node;

a capacitor which is coupled in parallel to said switch between the node and ground; and a shaping circuit coupled to the constant current source, the switch and the comparator and generating the control signal based on the signal received from the node, said switch being open when the output signal level of said rectifying circuit means is less than or equal to the reference level and being closed to short-circuit said capacitor when the output signal level of said rectifying circuit means is greater than the reference level.

6. The speech detection circuit as claimed in claim 5, wherein the predetermined time is determined by a voltage of said capacitor at which said shaping circuit operates.

7. The speech detection circuit as claimed in claim 1, wherein the gain of said amplifier means is varied by varying an input resistance thereof.

8. The speech detection circuit as claimed in claim 1, which is applied to a mobile communication terminal and which comprises:

a transmitting system having a first part and a second part; and and a switch switching an operation mode between the normal mode and the power save mode, wherein the control signal output from said control circuit means controls said switch to supply a power source voltage to only the first part of the transmitting system in the power save mode, said second part having a power consumption greater than that of the first part.

* * * * *

UNITED STATES PATENT AND TRADEMARK OFFICE

CERTIFICATE OF CORRECTION

PATENT NO. : 5,371,800

DATED : December 6, 1994

INVENTOR(S) : Noriyoshi KOMATSU et al.

It is certified that error appears in the above-indentified patent and that said Letters Patent is hereby corrected as shown below:

Column 5, Line 29, change "Control" to --control--.

Signed and Sealed this

Thirteenth Day of June, 1995

*Attest:*

Bruce Lehman

BRUCE LEHMAN

*Attesting Officer*

*Commissioner of Patents and Trademarks*